United States Patent [19]

Van Egmond

[11] Patent Number: 5,060,287

[45] Date of Patent: Oct. 22, 1991

[54] HEATER UTILIZING COPPER-NICKEL ALLOY CORE

[75] Inventor: Cornelius F. H. Van Egmond, Houston, Tex.

[73] Assignee: Shell Oil Company, Houston, Tex.

[21] Appl. No.: 622,025

[22] Filed: Dec. 4, 1990

[51] Int. Cl.[5] ..... E21B 23/00; H05B 3/40

[52] U.S. Cl. ..... 392/301; 219/553; 219/548; 166/272; 166/60; 175/16; 420/485; 338/214

[58] Field of Search ..... 392/301-306; 219/552-553, 543, 548, 523; 166/57, 272, 60; 175/16; 299/14; 405/131; 420/485; 338/214

[56] References Cited

U.S. PATENT DOCUMENTS

| | | | |
|---|---|---|---|
| 2,500,513 | 3/1950 | Bowman | 166/17 |
| 2,512,226 | 6/1950 | Edwards | 392/304 |
| 2,732,195 | 1/1956 | Ljungstrom | 262/3 |
| 2,781,851 | 2/1957 | Smith | 166/60 |
| 2,893,490 | 7/1959 | Williams et al. | 166/60 |
| 3,104,705 | 9/1963 | Ortloff et al. | 166/39 |
| 3,114,417 | 12/1963 | McCarthy | 166/60 |
| 3,131,763 | 5/1964 | Kunetka et al. | 166/60 |
| 3,207,220 | 9/1965 | Williams | 166/60 |
| 3,522,847 | 8/1970 | New | 166/60 |
| 3,646,322 | 2/1972 | Speekman | 219/545 |
| 3,855,453 | 12/1974 | Manning et al. | 219/553 |
| 3,898,431 | 8/1975 | House et al. | 219/544 |
| 4,415,034 | 11/1983 | Bouck | 166/302 |
| 4,440,219 | 4/1984 | Engelder | 166/57 |
| 4,540,972 | 9/1985 | Davis | 219/552 |
| 4,570,715 | 2/1986 | Van Meurs et al. | 166/302 |
| 4,572,299 | 2/1986 | Van Egmond et al. | 166/385 |
| 4,616,705 | 10/1986 | Stegemeier et al. | 166/250 |
| 4,704,514 | 11/1987 | Van Egmond et al. | 219/278 |
| 4,733,059 | 3/1988 | Goss et al. | 219/553 |
| 4,739,155 | 4/1988 | Rodgers et al. | 219/539 |

OTHER PUBLICATIONS

Harrison Alloys Inc. Product Bulletin, "Properties of Major Alloys", 4/91.

*Primary Examiner*—Bruce A. Reynolds
*Assistant Examiner*—John A. Jeffery

[57] ABSTRACT

An electrical resistance heater is provided which utilizes a copper-nickel alloy heating cable. This metallurgy heating cable is significantly less prone to failure due to localized overheating because the alloy has a low temperature coefficient of resistance. Used as a well heater, the heating cable permits heating of long segments of subterranean earth formation with a power supply of 400 to 1200 volts.

13 Claims, 3 Drawing Sheets

HEATER UTILIZING COPPER-NICKEL ALLOY CORE

FIELD OF THE INVENTION

This invention relates to improved electrical resistance heaters.

BACKGROUND OF THE INVENTION

Electrical resistance heaters suitable for heating long intervals of subterranean earth formations have been under development for many years. These heaters have been found to be useful for carbonizing hydrocarbon-containing zones for use as electrodes within reservoir formations, for enhanced oil recovery and for recovery of hydrocarbons from oil shales. U.S. Pat. No. 2,732,195 discloses a process to create electrodes utilizing a subterranean heater. The heater utilized is capable of heating an interval of 20 to 30 meters within subterranean oil shales to temperatures of 500° C. to 1000° C. Iron or chromium alloy resistors are utilized as the core heating element. These heating elements have a high resistance and relatively large voltage is required for the heater to extend over a long interval with a reasonable heat flux. It would be preferable to utilize lower resistance material. Further, it would be preferable to use a material which is malleable to permit more economical fabrication of the heater.

Subterranean heaters having copper core heating elements are disclosed in U.S. Pat. No. 4,570,715. This core has a low resistance, which permits heating long intervals of subterranean earth with a reasonable voltage across the elements. Further, because copper is a malleable material, this heater is much more economical to fabricate. These heaters can heat 1000-foot intervals of earth formations to temperatures of 600° C. to 1000° C. with 100 to 200 watts per foot of heating capacity with a 1200 volt power source. But copper also has shortcomings as a material for a heating element. As the temperature of a copper heating element increases, the electrical resistance increases at a rate which is undesirably high. If a segment of the heating coil becomes excessively hot, the increase in electrical resistance of the hot segment causes a cascading effect which can result in failure of the element.

A subterranean heater utilizing an electric resistant heater element having a lower temperature coefficient of resistance would not only improve temperature stability, but would simplify the power supply circuitry.

It is therefore the object of the present invention to provide an improved heater capable of heating long intervals of subterranean earth wherein the heating element has a low temperature coefficient of resistance, a low electrical resistance, and utilizes a core of a malleable metal material.

SUMMARY OF THE INVENTION

The object of the present invention is accomplished by providing a heater having a long heating element, the heater comprising:

a) at least one electrical heating cable which comprises a core comprising about 6 percent by weight of nickel and about 94 percent by weight of copper; and b) a means for supplying electrical current through the electrical heating cable.

When this copper-nickel alloy is incorporated into such a heater cable the benefits of a low resistance heater are obtained along with the benefit of having a low temperature coefficient of resistance. The heater cable material is also malleable. Such a heater can therefore be utilized to heat subterranean intervals of earth to temperatures of 500° C. to 1000° C. utilizing voltages in the range of 400 to 1000 Volts.

These heater coils are less likely to fail prematurely because the resistance of the cable in hot segments is much nearer to the resistance of the remaining coil. Hot spots therefore have less tendency to continue to increase in temperature due to higher electrical resistance, causing premature failure. The electrical resistance of the element also varies less between the initial cool state and the service temperatures which simplifies the power supply circuitry. The benefits of the low resistance and low temperature coefficient of resistance heater element of the present invention are most significant when the heater is one which applies heat over large intervals of subterranean earth and at a temperature level of 600° C. to 1000° C. Intervals of 1000 feet or more can be heated with these heaters.

DETAILED DESCRIPTION OF THE INVENTION

Figure 1:
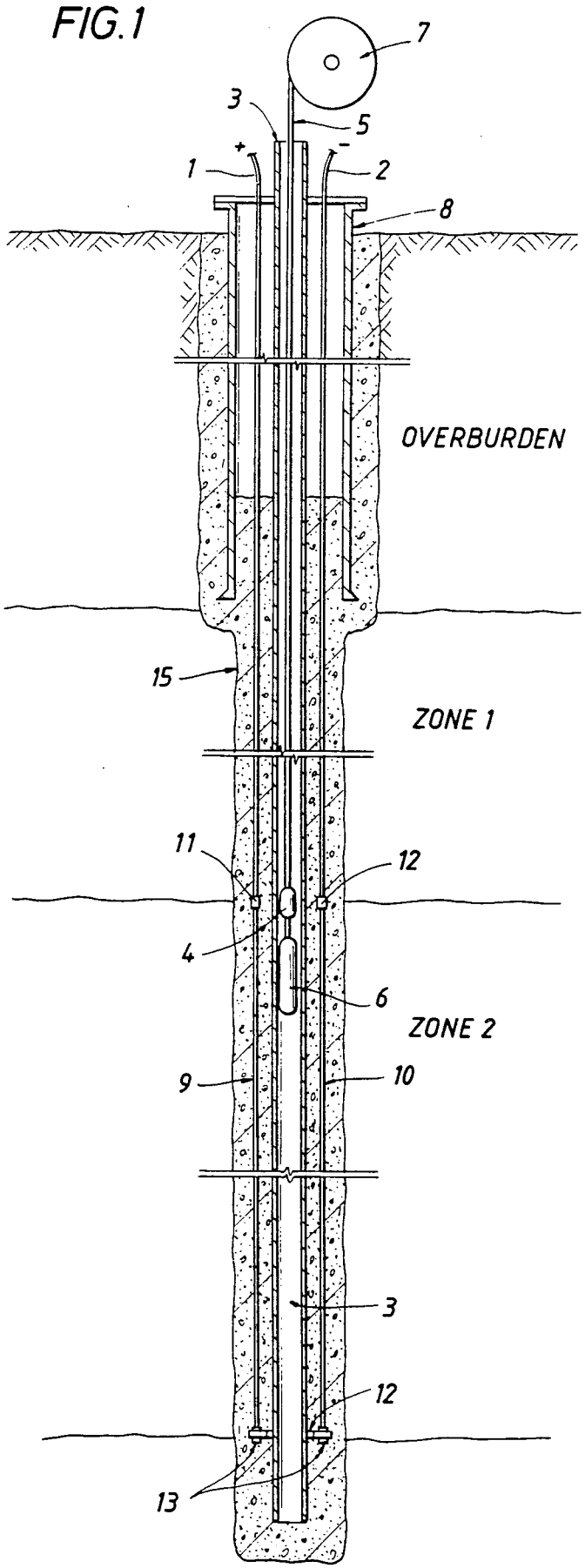
FIG. 1 is a schematic illustration of a heater of the present invention being installed within a well.

The heater of this invention is any heater wherein a long element is utilized. The long element necessitates the use of a material which has a low electrical resistance. Copper is such a material, but copper is prone to forming hot spots due to its high temperature coefficient of resistance. An alloy of about 6 percent by weight nickel and 94 percent by weight copper, known as LOHM, has both a relatively low resistance, and a low temperature coefficient of resistance. This results in a more simple power supply circuitry, and less of a tendency to form hot spots. The long element heaters of this invention can be utilized in subterranean oil recovery or coal shale hydrocarbon recovery. These types of heaters are often referred to as well heaters.

A preferred basic heater design for the practice of this invention is described in U.S. Pat. No. 4,570,715, incorporated herein by reference. The well heaters may be of other designs because the present invention is broadly an Improved heater core metallurgy which can be utilized in numerous long heater designs.

The reason for the decreased tendency to form "hot spots" which result in premature heater core failures can be seen from comparing the "normalized resistance" of different potential heater core materials. The normalized resistance is the resistance of a metal at a temperature divided by the resistance of that metal at room temperature. Because resistances of metal change almost linearly with temperature, a metal with a lower normalized resistance at an elevated temperature will have a much lower relative change in heat output if the temperature of the core increases. Normalized resistance of nickel and copper at 800° C. are about 5.8 and about 4.8, respectively. The normalized resistance of "30 Alloy" at 800° C. is about 2.2. The normalized resistance at 800° C. of an alloy of 6% nickel and the balance copper is only about 1.5. This reflects a significant advantage in expected heater core life.

Nichrome alloy also has an excellent normalized resistance. At 800° C. the normalized resistance is only about 1.12. But, the electrical resistance is over three times that of nickel at 800° C., and about 27 times that of copper. Nichrome is also not a malleable metal. In spite of the very low normalized resistance of Nichrome, its high resistance and lack of malleability render it undesirable as a long heater core metal.

In a preferred embodiment of the present invention the heater is a well heater with a heater core inside a metal sheath. The heater core and metal sheath are separated by a space, and the space is packed with mineral insulation material. The uphole ends of the sheathed heating element cables are connected to power supply cables. Power supply cables are heat-stable similarly insulated and sheathed cables containing cores having ratios of cross-sectional area to resistance making them capable of transmitting the current flowing through the heating elements while generating heat at a significantly lower rate. The power supply cables are preferably copper sheathed, mineral insulated, and copper cored, and have cross-sectional areas large enough to generate only an insignificant amount of heat while supplying all of the current needed to generate the selected temperature in the heated zone.

Splices of the cores in cables in which mineral insulations and metal sheaths encase current-conducting cores are preferably surrounded by relatively short lengths of metal sleeves enclosing the portions in which the cable cores are welded together or otherwise electrically interconnected. Such electrical connections should provide joint resistance a least as low as that of the least electrically resistive cable core being joined. Also, an insulation of particulate material having properties of electrical resistivity, compressive strength, and heat conductance at least substantially equalling those of the cable insulations, is preferably compacted around the cores which are spliced.

FIG. 1 shows a well, 15, which extends through a layer of "overburden" and zones 1 and 2 of an earth formation. Zone 2 is a zone which is to be heated.

As seen from the top down, the heater assembly consists of a pair of spoolable electric power supply cables 1 and 2, an optional thermowell 3. A thermocouple, 4, is suspended by a thermocouple wire 5, and held taut by a sinker bar, 6. The thermocouple may be raised or lowered by rotating a spool, 7. The preferred embodiment is to cement the heating cables direct in place, as shown in FIG. 1. In the preferred heater, the casing does not extend to the zone which the heater is to heat. At the interface of the zone which is to be heated, zone Z, and the zone which is not to be heated, zone 1, power supply cables, 1 and 2, are spliced to heater cables, 9 and 10, through splices, 11 and 12. The heating cables extend downward to the bottom of the zone to be heated. At the bottom of the heating cables the heater cores are grounded to the cable sheaths with termination plugs, 13. The termination plugs may be electrically connected by a means such as the coupler, 12.

The thermowell, power supply cable and heating cables may be suspended within a casing. If they are suspended within a casing, the bottom of the casing should be sealed to prevent liquids from entering. Liquids present within the casing in the zone to be heated would limit the temperatures which could be achieved due to the liquids vaporizing, rising up the casing, and condensing in the casing above the heating cables. The condensed liquids would then fall down to the heating cables, thus preventing high temperatures from being achieved. The preferred embodiment, as illustrated in FIG. 1, does not include a casing in the zone to be heated. The heating cables and thermowell are cemented in the borehole. When the heating cable is cemented in the borehole, the heating cable sheath must be a material that will protect the heating cable from corrosion due to the exposure of the heating cable to subterranean elements.

Cementing the thermowell and heating cable into the borehole, and eliminating at least this portion of the casing, reduces the expense of the installation considerably. 1: a casing is used, it must be fabricated from expensive materials due to the high temperature and corrosive environment. Heat transfer is also improved when the casing is eliminated due to the absence of the vapor space around the heating cable. A smaller diameter well hole can also be utilized. The smaller diameter hole may result in less cement being required to cement the heating cables than what would be required to cement a casing into a borehole along with reducing drilling costs. The problems involved with hermetically sealing the casing to exclude liquids from entering are also avoided by elimination of the casing. Cementing the heating cables directly into the borehole also eliminates thermal expansion and creep by securing the heating cables into their initial positions.

Figure 2:
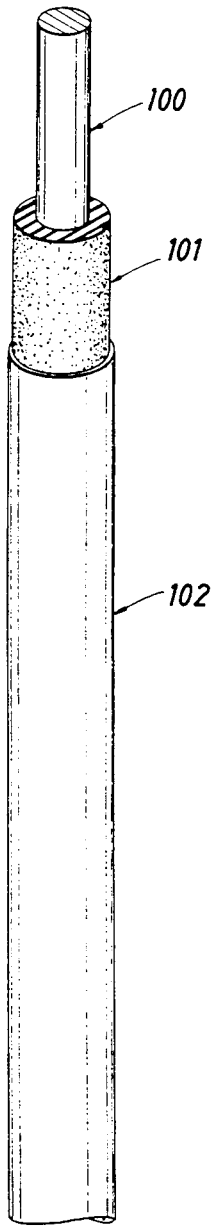
FIG. 2 is a three-dimensional illustration of an insulated and sheathed heating element of the present invention.
Figure 5:
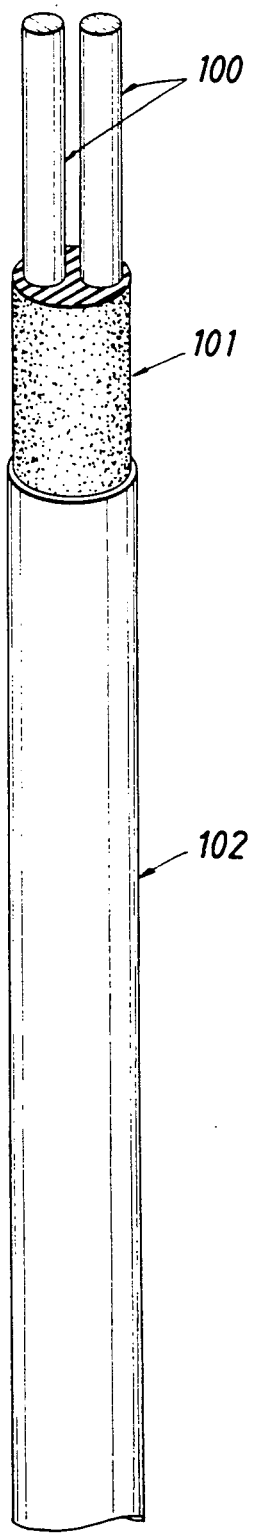
FIG. 5 is a three-dimensional illustration of an insulated and sheathed heating element of the present invention having two cores.
Figure 6:
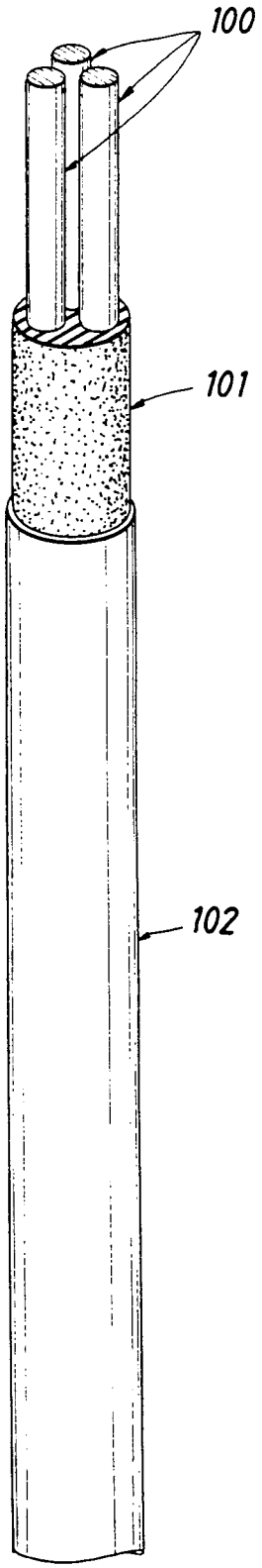
FIG. 6 is a three-dimensional illustration of an insulated and sheathed heating element of the present invention having three cores.

FIGS. 2, 5, and 6 display one, two, and three cored heating cables, respectively, in a preferred structural arrangement of the heating and power supply cables. Referring to FIGS. 2, 5 and 6 an electrically conductive core, 100, is cores 100, are surrounded by an annular mass of compressed mineral insulating material, 101, which is surrounded by a metal sheath, 102. The metal sheath may optionally be fabricated in two layers (not shown). A relatively thin inner layer may be fabricated initially, and a thicker outer layer of a material resistant to corrosion could then be added in a separate step.

Figure 3:
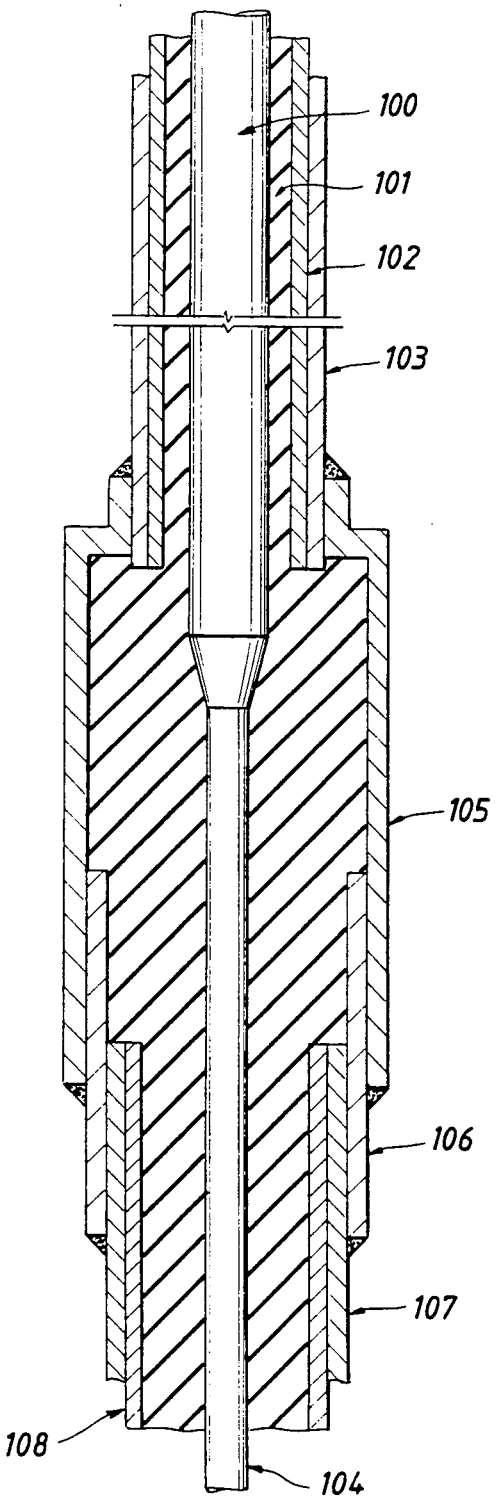
FIG. 3 is a cross-sectional illustration of power cable to heating cable splice of the present invention.

FIG. 3 displays details of the splice 9, of FIG. 1. The power supply cable consisting of the electrical conductive core, 100, is surrounded by compressed mineral insulation, 101, covered by a sheath, 102. The electrical conductive core of the power supply cable is preferably copper and is of a sufficiently large cross-sectional area to prevent a significant amount of heat from being generated under operating conditions. The sheath of the power supply cable is preferably copper. A transition sheath, 103, extends up from the coupled end of the power supply cable in order to protect the sheath from corrosion due to the elevated temperature near the heating cable. This protective sheath is preferably the same material as the sheathing material of the heating cable. The protective sheathing could extend for a distance of between a few feet to over 40 feet. A distance of about 40 feet is preferred. This distance ensures that the power supply cable is not damaged as a result of exposure to high temperatures in the vicinity of the heating cables.

In FIG. 3, the heating cable sheath is shown as the preferred two-layer sheath of an inner sheath, 108, and an outer sheath, 107. The core of the heating cable, 104, is welded to the power supply cable core, 100. The heating cable is of a cross section area and resistance such as to create from 50 to 250 watts per foot of heat at operating currents. The coupling sleeve, 105, and compression sleeve, 106, are slid onto either the power supply cable or heating cable prior to the cores of the cables being welded. After the cores are welded together, the coupling sleeve, 105, is welded into place onto the power supply cable. The space around the power supply cable core to heating cable core is then filled with a mineral insulating material. The mineral insulating material is then compressed by sliding the compression sleeve, 106, into the space between the sleeve coupling and the heating cable. After the compression sleeve is forced into this space, it is sealed by welded connections to the heating cable outer sheath, 107, and the coupling sleeve.

For use in the present invention, the diameter and thickness of the sheath is preferably small enough to provide a cable which is "spoolable", i.e., can be readily coiled and uncoiled from spools without crimping the sheath or redistributing the insulating material. The diameter of the electrically conductive core within the cable can be varied to allow different amounts of current to be carried while generating significant or insignificant amounts of heat, depending upon whether the conductive core is a heating cable or a power supply cable.

When the heating cable is utilized in a well with a casing, the sheath of the heating cable is preferably a single layer sheath of 316 stainless steel or the equivalent. When the heating cable is cemented directly into the borehole without a casing, a double layer sheath is preferred. The inner layer and the outer layer are both preferably INCOLOY 800®. A total sheath thickness of about one-quarter inch is preferred although a thickness of from one-eighth inch to one-half inch can be acceptable depending upon the service time desired, operating temperatures, and the corrosiveness of the operating environment.

FIG. 3 displays a one core element, but it is most preferred that the cable be fabricated with two or three cores. The multiple cores can each carry electricity, and eliminate the need for parallel heating and power supply cables. A single-phase alternating current power supply requires two cores per cable in the most preferred embodiment of this invention, and a three-phase alternating power supply requires three cores per cable.

Figure 4:
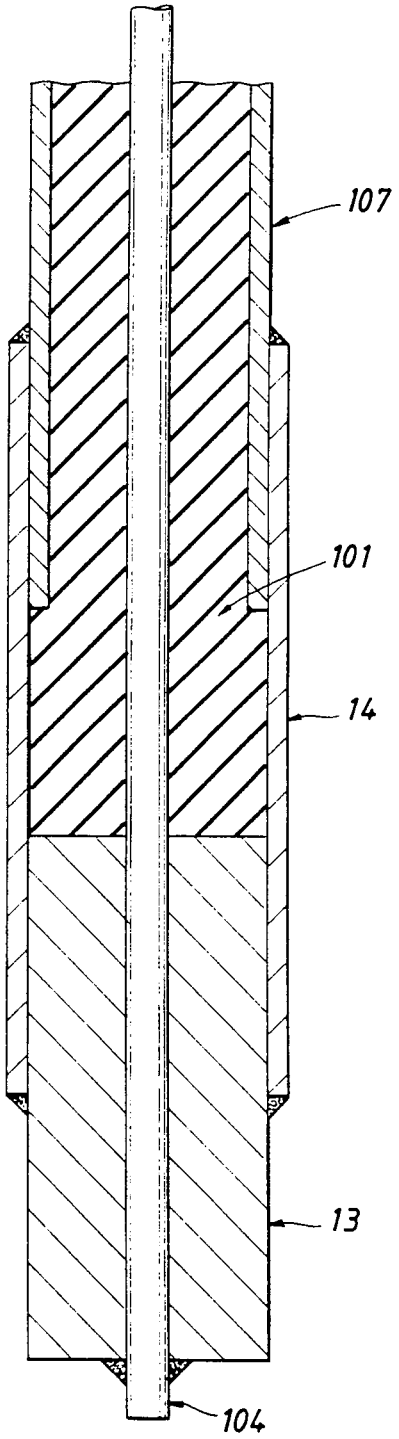
FIG. 4 is a cross-sectional illustration of the heating cable bottom terminal plug.

The heating cable cores are preferably grounded at the extremity of the heating cable opposite the end of the heating cable which is coupled to the power supply cables. FIG. 1 includes the preferred termination plugs, 13, connected by an electrically conductive end coupler, 12. FIG. 4 displays the preferred termination plug. The plug, 13, is forced into a termination sleeve, 19, which had been previously welded onto the sheath of the power supply cable, 107. The termination plug is forced into the sleeve to compress the mineral insulating material, 101. The termination plug is then brazed onto the heating cable core, 104, and welded to the termination sleeve. The termination plugs on each heating cable may be clamped together, as shown in FIG. 1. When a heating cable with multiple cores is utilized, the termination plug has a hole for each, and the plug serves to electrically connect the cables.

The use of LOHM as the heater cable core material significantly simplifies power circuitry by permitting zero crossover rather than phase angle control of electrical current to the heater. The prior art copper cored heater cables have a large difference between hot and cold resistances, and therefore large differences between hot and cold electrical current requirements for similar amounts of heat output.

Zero crossover electrical heater firing control is achieved by allowing full supply voltage to pass through the heating cable for a specific number of cycles, starting at the "crossover", where instantaneous voltage is zero, and continuing for a specific number of complete cycles, discontinuing when the instantaneous voltage again crosses zero. A specific number of cycles are then blocked, allowing control of the heat output by the heating cable. The system may be arranged to "block" 15 or 20 cycles out of each 60. This control is not practical when the circuitry must be sized for a resistance that varies significantly because this varying resistance would cause the current required to vary excessively. Zero crossover heater firing is therefore not practical with prior art copper core heaters, but is generally acceptable with a LOHM core heater. The alternative firing control which is required by prior art copper core heaters is phase angle firing. Phase angle firing passes a portion of each power cycle to the heater core. The power is applied with a non-zero voltage and continues until the voltage passes to zero. Because voltage is applied to the system starting with a voltage differential, a considerable spike of amperage occurs, which the system must be designed to handle. The zero crossover power control is therefore generally preferred, and systems which may incorporate zero crossover power control are advantageous.

A thermowell may be incorporated into a well borehole which incorporates the heater of the present invention. The thermowell may be incorporated into a well either with or without a casing. When the well does not include a casing, the thermowell must be of a metallurgy and thickness to withstand corrosion by the subterranean environment. A thermowell and temperature logging process such as that disclosed in U.S. Pat. No. 4,616,705 is preferred. Due to the expense of providing a thermowell and temperature sensing facilities, it is envisioned that only a small number of thermowells would be provided in heating wells within a formation to be heated.

Subterranean earth formations which contain varying thermal conductivities may require segmented heating cables, with heat outputs per foot adjusted to provide a more nearly constant well heater temperature profile. Such a segmented heater is described in U.S. Pat. No. 4,570,715. The greatly reduced tendency of LOHM core well heaters to develop hot spots greatly reduces the need for the well heater core to have a heat output which is correlated with local variations in subterranean thermal conductivities, but the technique of segmenting the heater coil may be beneficial, and required to reach maximum heat inputs into specific formations.

What is claimed is:

1. A long electrical heater comprising:

a) at least one electrical heating cable having a heating core, the core comprising about 6 percent by weight nickel and about 94 percent by weight of copper; and b) a means for supplying electric current through the electrical heating cable.

2. The heater of claim 1 wherein the heater is a well heater capable of supplying about 50 to 250 watts of heat per foot of heater length into a subterranean earth formation.

3. The heater of claim 1 wherein the heating cable contains a core consisting essentially of about 6 percent by weight nickel and about 94 percent by weight copper.

4. The heater of claim 1 in which the electrical heating cable further comprises a metal sheath surrounding the core, and an electrical insulation material between the metal sheath and the core.

5. The heater of claim 4 further comprising at least one power supply section which contains at least one heat stable cable comprising a core, mineral insulation and sheath wherein the combination of core crosssectional area and resistance generates significantly less heat per applied voltage than the heating cable.

6. The heater of claim 2 wherein the heating cable is within a casing, and kept isolated from any fluid flowing onto or out of the formations.

7. The heater of claim 2 wherein the combination of heating cable core cross-section areas and resistances are arranged relative to a pattern of heat conductivity with distance along the interval within the earth formations to he heated so that localized increases and decreases in the average electrical resistance with distance along the heater have relative magnitudes and locations correlated with those of localized increases and decreases in the heat conductivity in the adjacent earth formations.

8. The heater of claim 2 wherein the heater is a spoolable cable capable of being inserted into a well borehole by spooling means.

9. The heater of claim 9 wherein the heater comprises a core which consists essentially of about 6 percent by weight nickel and about 94 percent by weight copper.

10. The heater of claim 2 wherein the heating cable consists of two cores within a sheath, electrical insulating material separating the cores from each other and separating the cores from the sheath, a top end to which electrical power is supplied, and a bottom end.

11. The heater of claim 11 wherein the two cores within the sheath are connected at the bottom.

12. The heater of claim 2 wherein the heating cable consists of three cores within a sheath, electrical insulating material separating the cores from each other and separating the cores from the sheath, a top end to which three-phase electrical power is supplied to the three cores, and a bottom end, wherein the three cables are connected by an electrically conductive connecting means at the bottom end of the cables.

13. A well heater comprising:

a) at least one heating section which
   i) is capable of extending for at least a hundred feet within a well borehole adjacent to an interval of subterranean earth formation to be heated,
   ii) contains at least one electrical heating cable, and
   iii) contains a combination of heating cable core resistance and core cross-sectional areas capable of producing temperatures between about 600° C. and 1000° C. within the subterranean earth formation, wherein the heating cable is an electrical resistance heating cable comprising: a core consisting essentially of 6 percent by weight nickel and 94 percent by weight copper; electrical insulation surrounding the core; and surrounding the electrical insulation, a metal sheath; and b) a means of supplying electrical power to the heating cable core.

* * * * *